US007676959B2

(12) United States Patent
Wilder

(10) Patent No.: US 7,676,959 B2
(45) Date of Patent: Mar. 16, 2010

(54) CONTOURED SKATE BOOT

(75) Inventor: Thomas V. Wilder, Laguna Niguel, CA (US)

(73) Assignee: Mission Itech Hockey, Inc., Irvine, CA (US)

( * ) Notice: Subject to any disclaimer, the term of this patent is extended or adjusted under 35 U.S.C. 154(b) by 552 days.

(21) Appl. No.: 11/430,754

(22) Filed: May 9, 2006

(65) Prior Publication Data

US 2006/0201030 A1 Sep. 14, 2006

Related U.S. Application Data

(62) Division of application No. 10/616,015, filed on Jul. 9, 2003, now Pat. No. 7,039,977.

(60) Provisional application No. 60/424,396, filed on Nov. 6, 2002.

(51) Int. Cl.
*A43B 23/02* (2006.01)
*A43B 23/00* (2006.01)

(52) U.S. Cl. ..... 36/117.1; 36/47; 36/48

(58) Field of Classification Search ..... 36/47, 36/48, 117.1, 46.4, 68, 69, 71, 88, 89, 115, 36/116

See application file for complete search history.

(56) References Cited

U.S. PATENT DOCUMENTS

| | | | | | |
|---|---|---|---|---|---|
| 6,009 | A | | 1/1849 | Kelleher et al. | |
| 6,098 | A | * | 2/1849 | Kelleher et al. | 298/17 R |
| 6,099 | A | * | 2/1849 | Kelleher et al. | 112/199 |
| 122,030 | A | * | 12/1871 | Kelleher et al. | 36/47 |
| 300,526 | A | * | 6/1884 | Stowe | 36/47 |
| 618,559 | A | | 1/1899 | Chase | |
| 622,444 | A | | 4/1899 | Chase | |
| 1,839,274 | A | * | 1/1932 | Sundean | 36/54 |
| 3,128,567 | A | * | 4/1964 | Huard | 36/48 |
| 3,590,411 | A | | 7/1971 | Zemlin | |
| 3,659,361 | A | | 5/1972 | White, Sr. | |
| 3,925,916 | A | | 12/1975 | Garbuio | |
| 4,509,276 | A | | 4/1985 | Bourque | |
| 4,780,969 | A | | 11/1988 | White, Jr. | |
| 4,835,885 | A | | 6/1989 | Hoshizaki et al. | |
| 4,876,806 | A | | 10/1989 | Robinson | |

(Continued)

FOREIGN PATENT DOCUMENTS

| | | |
|---|---|---|
| EP | 0475916 A2 | 3/1992 |

(Continued)

*Primary Examiner*—Jila M Mohandesi
(74) *Attorney, Agent, or Firm*—Knobbe, Martens, Olson & Bear, LLP

(57) ABSTRACT

Embodiments of the present invention contemplated herein describe a contoured skate boot having contour seams formed therein for introducing preferential biases in the boot material. By strategically creating notches in the boot upper material and subsequently rejoining the edges of each notch, the boot upper may be biased to conform to the complex contours of a skater's foot and ankle. Moreover, by introducing boot contours such that the boot is able to closer approximate the natural contours of a skater's foot, fewer stiffeners and less padding is required to result in a comfortable fit while providing increased control of the boot. Additionally, by reducing the quantity of stiffeners and volume of padding, a lighter boot is provided, thus resulting in a more efficient energy transfer from the skater through the skate.

12 Claims, 10 Drawing Sheets

U.S. PATENT DOCUMENTS

| | | | | |
|---|---|---|---|---|
| 4,960,135 | A | 10/1990 | Nelson | |
| 4,972,613 | A | 11/1990 | Loveder | |
| 5,746,015 | A | 5/1998 | Clemente et al. | |
| 5,775,008 | A | 7/1998 | Bussell et al. | |
| 5,784,809 | A | 7/1998 | McDonald | |
| 6,102,412 | A | 8/2000 | Staffaroni | |
| 6,212,796 | B1 | 4/2001 | Kubelka | |
| 6,295,679 | B1 | 10/2001 | Chenevert | |
| 6,298,583 | B1 * | 10/2001 | Allen | 36/100 |
| 6,381,877 | B2 | 5/2002 | Filice | |
| 6,748,676 | B1 | 6/2004 | Chenevert | |
| 6,871,424 | B2 | 3/2005 | Labonteet et al. | |
| 2004/0226113 | A1 | 11/2004 | Wright et al. | |

FOREIGN PATENT DOCUMENTS

| | | |
|---|---|---|
| EP | 1 110 468 A2 | 6/2001 |
| WO | WO 94/03079 | 2/1994 |
| WO | WO 2004/069351 | 8/2004 |

* cited by examiner

CONTOURED SKATE BOOT

RELATED APPLICATIONS

This application claims priority as a division of U.S. application Ser. No. 10/616,015, which was filed on Jul. 9, 2003, now U.S. Pat. No. 7,039,977 which is based on and claims the benefit of U.S. Application Ser. No. 60/424,396, which was filed on Nov. 6, 2002. The entirety of each priority application is hereby incorporated by reference.

BACKGROUND OF THE INVENTION

1. Field of the Invention

The present invention relates generally to the field of boots, and more particularly to the field of skate boots, such as for ice and roller skating.

2. Description of the Related Art

Three important features of a boot, especially for competitive athletes, are control, comfort, and weight. A skater desires a high level of control in transferring leg and foot movements into boot movements, while maintaining a high level of comfort. Additionally, a light boot requires less skater exertion to manipulate, thereby providing a more efficient transfer of energy into propulsion. Sport boots for skating, such as ice or roller skating, are typically made by one of two methods. Higher-end boots tend to be hand made of textile materials, while mass produced boots are generally molded out of stiff plastics and incorporate cushion inserts. Each method offers conveniences and advantages along with associated disadvantages.

Hand made boots are crafted by forming and stretching a skin over a last. A last is a three-dimensional male mold of the desired inside cavity of the finished boot, generally resembling a human foot. Typically, a skin, or pre-assembled fabric component, is heated and positioned over the last and is then stretched to conform to the contours of the last while adhering or fastening the fabric component to an insole. The skin may consist of several pieces and layers of material glued or sewn together, and may further have rigid components pre-attached to assist in shaping the skin over the last and to provide protection to a skater's foot within the boot. The insole, which forms the inside bottom of the boot, is nailed or tacked and glued to the skin to maintain the desired shape. Hand crafting boots in this manner results in a custom-fitted boot, and is often used to create custom boots for competitive athletes.

While this process can result in excellent quality boots, the process of stretching the skin over the last while securing it in its desired shape with adhesives and/or fasteners is difficult and labor intensive. For instance, the skin is originally formed from one or more substantially flat pieces of material which resist conforming to the complex contours of the last. As such, the skin often does not correspond closely to the contours of the last. This is especially true when the skin is constructed of thick or stiff materials. Moreover, leather—the generally preferred material because of its breathability, durability, and quality over other textiles—may stretch and crease after repeated use, thereby deforming from its sought after custom-fit shape, and thus eliminating some of the benefits of a hand-crafted boot.

Typical skate boots incorporate stiffeners to offer increased support to the wearer and increased protection against impacts from external objects such as hockey pucks, hockey sticks, and other skates. The stiffeners typically are attached either inside and/or outside the textile upper and are separated from the foot by padding, which provides comfort and helps reduce abrasion between the foot and boot. The stiffeners generally do not correspond to the complex contours of a foot and ankle, and thus the boot requires thick padding to occupy the volume between the stiffened boot upper and the foot and ankle. Consequently, the padding allows for movement of the foot and ankle within the boot, which results in boot slop about the foot; thus, more stiffeners may be required to provide adequate support. The boot slop may increase through regular use as the padding becomes less resilient and begins to develop memory from repeated deformation, thus providing less support to a skater's foot and ankle. As more stiffeners are integrated, the weight is undesirably increased.

An alternative boot making method results from molding a rigid outer shell and fitting a cushioned sleeve or liner within the shell. In many applications, a two-piece molded boot is hinged between an upper and lower section to allow for easier plantar flexion and dorsiflexion. The molded stiff outer shell does not typically track the contours of a skater's foot, and thus a thick layer of padding is required to occupy the volume between a skater's foot and the rigid boot outer shell. Similar to the hand-made boots described above, the cushioned liner is designed to provide comfort and is therefore deformable to offer a cushioned fit. Because the rigid boot is separated from the foot by the thick cushioned liner, the same drawbacks as described above result. However, unlike hand-made boots, molded boots are quite durable because of the chosen construction materials and are easier to manufacture than traditional hand-made boots.

SUMMARY OF THE PREFERRED EMBODIMENTS

There is thus a need for a boot that offers the desired fit, support, and flexibility of a hand made boot while reducing the manufacturing time, especially during the lasting process, and additionally offers the durability of a molded boot. Embodiments of the present contoured skate boot offers such advantages.

According to one embodiment of a contoured skate boot, a skate boot upper is made by providing a lateral quarter panel having both a curved heel edge and an ankle edge and a medial quarter panel having both a curved heel edge and an ankle edge. The quarter panels are connected along their respective heel edges to define a heel counter, which results in their respective ankle edges being substantially continuous. A generally flat ankle support panel has a curved lower edge that generally corresponds to the curved ankle edges of the quarter panels.

Material is removed from the ankle support panel to create one or more notches, with each notch being rejoined along its notch edges to create tension in the ankle panel. The ankle support panel is connected to the generally continuous edge of the quarter panel curved ankle edges.

According to another embodiment of the contoured skate boot, a skate boot upper is made by providing a lateral quarter panel and a medial quarter panel joined together at a heel counter, with each quarter panel having a curved ankle edge. An ankle support panel has a curved lower edge that does not match the curvature of the lateral quarter panel and medial quarter panel curved ankle edges. The curved lower edge of the ankle support panel is connected to the quarter panel curved ankle edges ankle edges.

The ankle support panel includes a lower edge and an upper edge defining an interior portion, and may have material removed to form a notch extending toward the interior portion from an edge of the ankle panel. The notch may be rejoined along its edges to form a bulge within the interior portion of the material.

According to another aspect, a skate boot upper is made by providing a lateral quarter panel having lower, upper, and rear edges. A notch is formed in the lateral quarter panel lower edge and the notch edges are joined together to form a bulge in the lateral quarter panel. Likewise, a medial quarter panel is provided having lower, upper, and rear edges and a notch is formed in the medial quarter panel lower edge. The notch edges are joined together to form a bulge in the medial quarter panel.

An ankle panel is provided having upper and lower edges, and medial and lateral surfaces. A notch is formed in the ankle panel lower edge and the notch edges together to form a bulge in the medial surface. Another notch is formed in the ankle panel lower edge and the notch edges are joined together to form a bulge in the lateral surface. The lateral quarter panel is joined to the medial quarter panel, and the ankle panel lower edge is joined to the lateral and medial quarter panel.

According to yet another aspect, a skate boot has a medial quarter panel having top, bottom, front, and rear edges. It also has a lateral quarter panel with top, bottom, front, and rear edges connected to the medial quarter panel along their respective rear edges.

An ankle cuff portion is disposed above the medial quarter panel and lateral quarter panel and has a medial malleolar bulge and a lateral malleolar bulge, which may be formed by removing material from the ankle cuff portion and rejoining the material at the removal location. The medial malleolar bulge may be disposed vertically higher than the lateral malleolar bulge.

The skate boot may further have a concave depression in the medial quarter panel for fitting the boot to a skater's medial longitudinal arch. The depression may be formed by removing material from one or more locations of the medial quarter panel and rejoining the material together at the removal location.

The skate boot may further have a bulge formed in the lateral quarter panel corresponding to the curvature of a skater's outstep. This bulge may be formed by removing material from one or more locations of the lateral quarter panel and rejoining the material together at the removal location.

The skate boot may have the medial quarter panel and lateral quarter panel joined together at their respective rear edges, and may further have the ankle cuff portion joined to the respective upper edges of the quarter panels.

The skate boot may further include an interior stiffener attached to the inside of the lateral quarter panel and/or the medial quarter panel. The interior stiffener may have contouring seams for introducing a contour into the interior stiffener. Additionally, an interior stiffener is a semi-rigid material and is configured to conform to the interior shape of the lateral and/or medial quarter panel, and may include lateral and medial malleolar bulges.

These and other features, aspects and advantages of the present invention will now be described with reference to the drawings of preferred embodiments, which embodiments are intended to illustrate and not to limit the present invention. The drawings comprise thirteen figures.

DETAILED DESCRIPTION OF THE PREFERRED EMBODIMENTS

In the following description, reference is made to the accompanying drawings which form a part of this written description which show, by way of illustration, specific embodiments in which the invention can be practiced. It is to be understood that other embodiments may be utilized and structural changes may be made without departing from the scope of the present invention. Where possible, the same reference numbers will be used throughout the drawings to refer to the same or like components. Numerous specific details are set forth in order to provide a thorough understanding of the present invention; however, it should be obvious to one skilled in the art that the present invention may be practiced without the specific details or with certain alternative equivalent devices and methods to those described herein. In other instances, well-known methods, procedures, components and devices have not been described in detail so as not to unnecessarily obscure aspects of the present invention.

Figure 1:
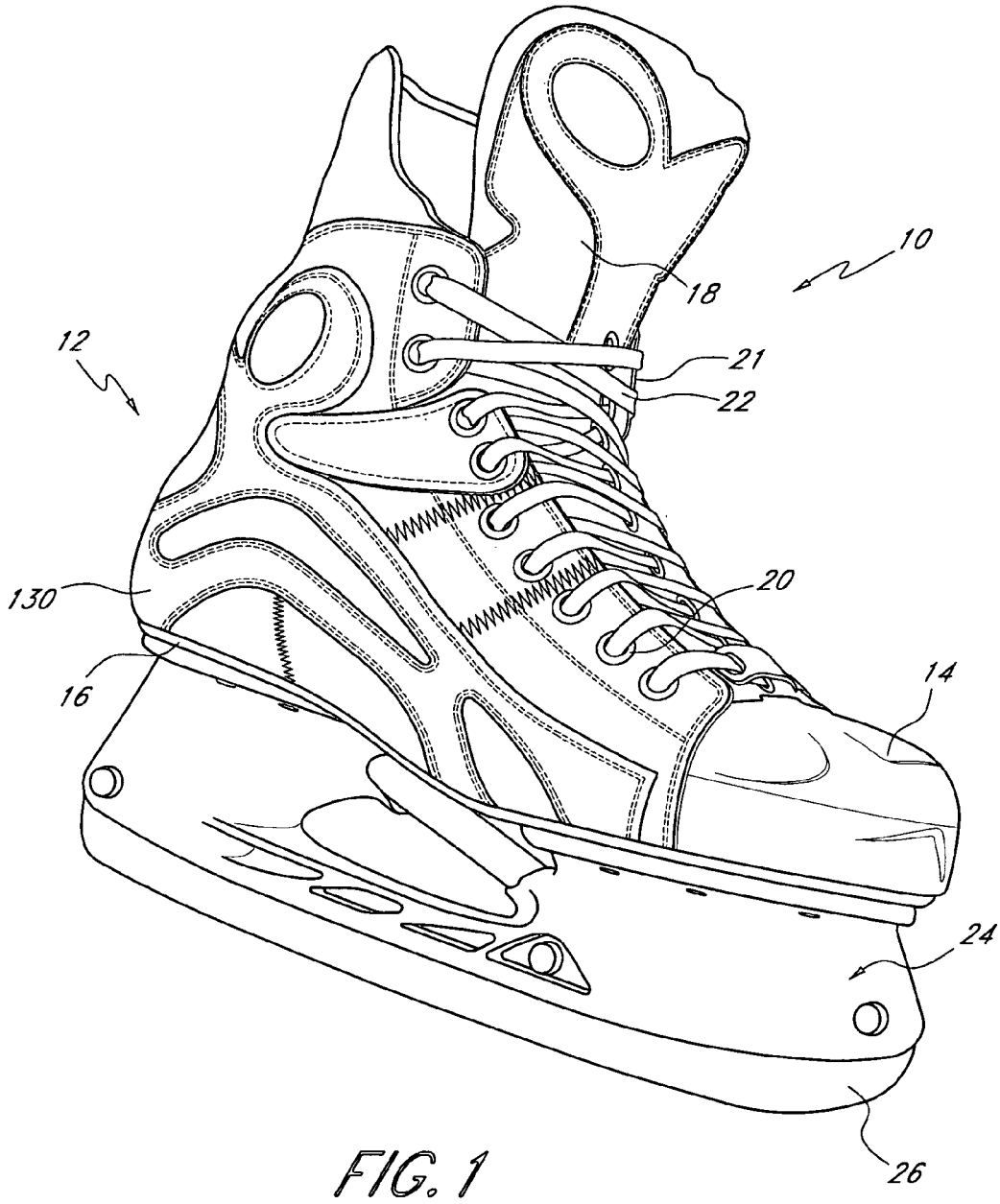
FIG. 1 is an isometric illustration of a boot made according to one embodiment of the present contoured skate boot shown attached to an ice blade holder and blade.
Figure 2:
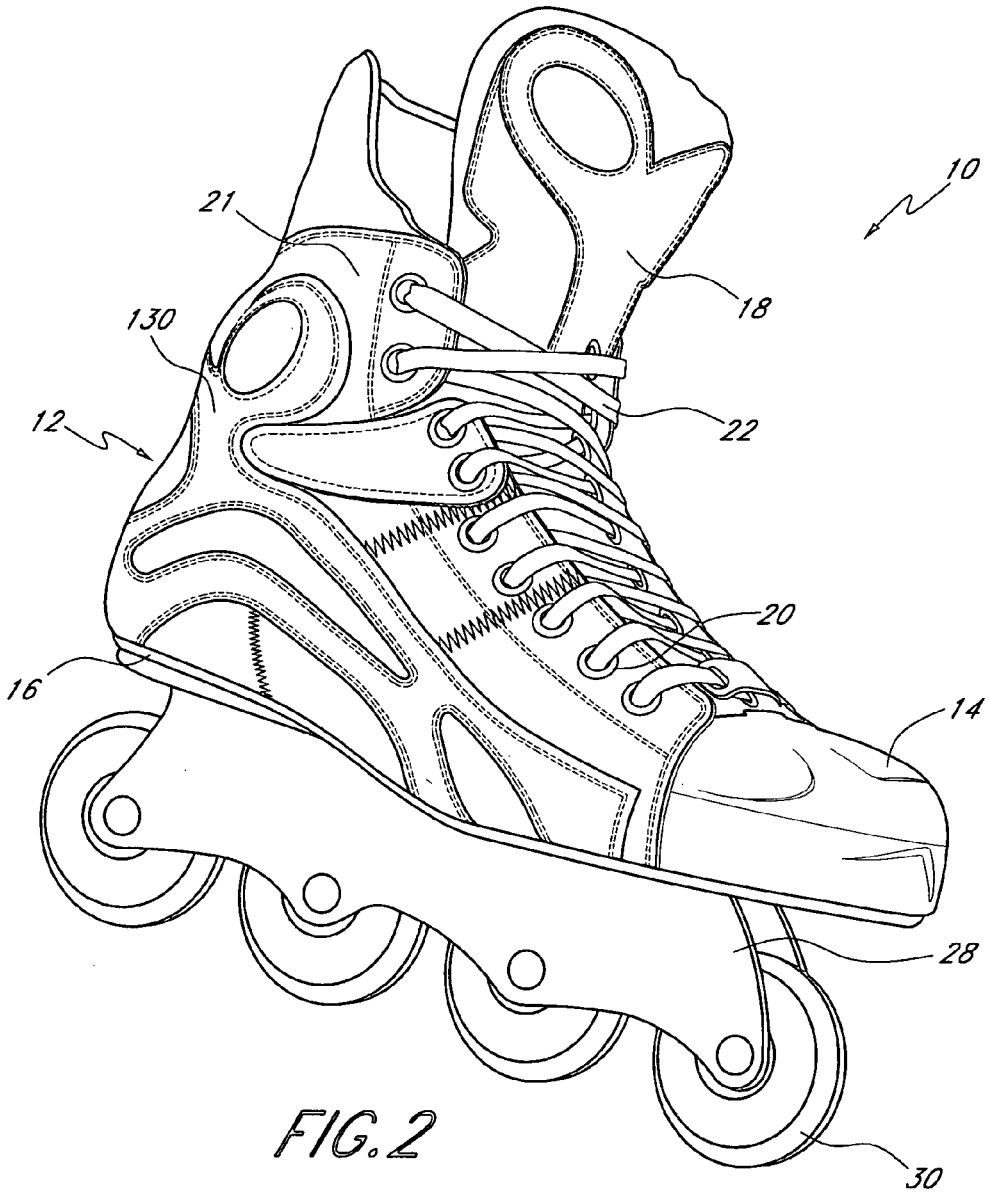
FIG. 2 is an isometric illustration of a boot made according to one embodiment of the present contoured skate boot shown attached to an inline roller skate chassis.

FIGS. 1 and 2 each illustrate embodiments of a skate boot 10 that overcomes the aforementioned problems by conforming to the complex contours of an ankle and foot. The illustrated skate boot 10 comprises a boot upper 12 secured to a toe cap 14. A rigid outsole 16 is fixed to the bottom of the boot upper 12 and toe cap 14. A tongue 18 extends upward from the toe cap 14, between spaced apart sets of eyelets 20, and beyond a cuff portion 21. A lace 22 zigzags through the opposing sets of eyelets 20 and provides a variable tension whereby a skater can appropriately tighten the boot about the skater's foot by tightening the lace. FIG. 1 illustrates the aforementioned boot having an attached blade holder 24 with concomitant blade 26. FIG. 2 differentiates by its inclusion of an inline roller chassis 28 with accompanying wheels 30.

The contoured boot described herein provides an improved fit that contours to a skater's foot and ankle to provide better control and power transfer from a skater's leg and ankle through the boot and to the skating surface than traditional boots are capable of. Before further describing aspects of some of the preferred embodiments, it becomes helpful to briefly discuss the anatomy of the human foot and ankle and its associated complex contours.

Figure 3:
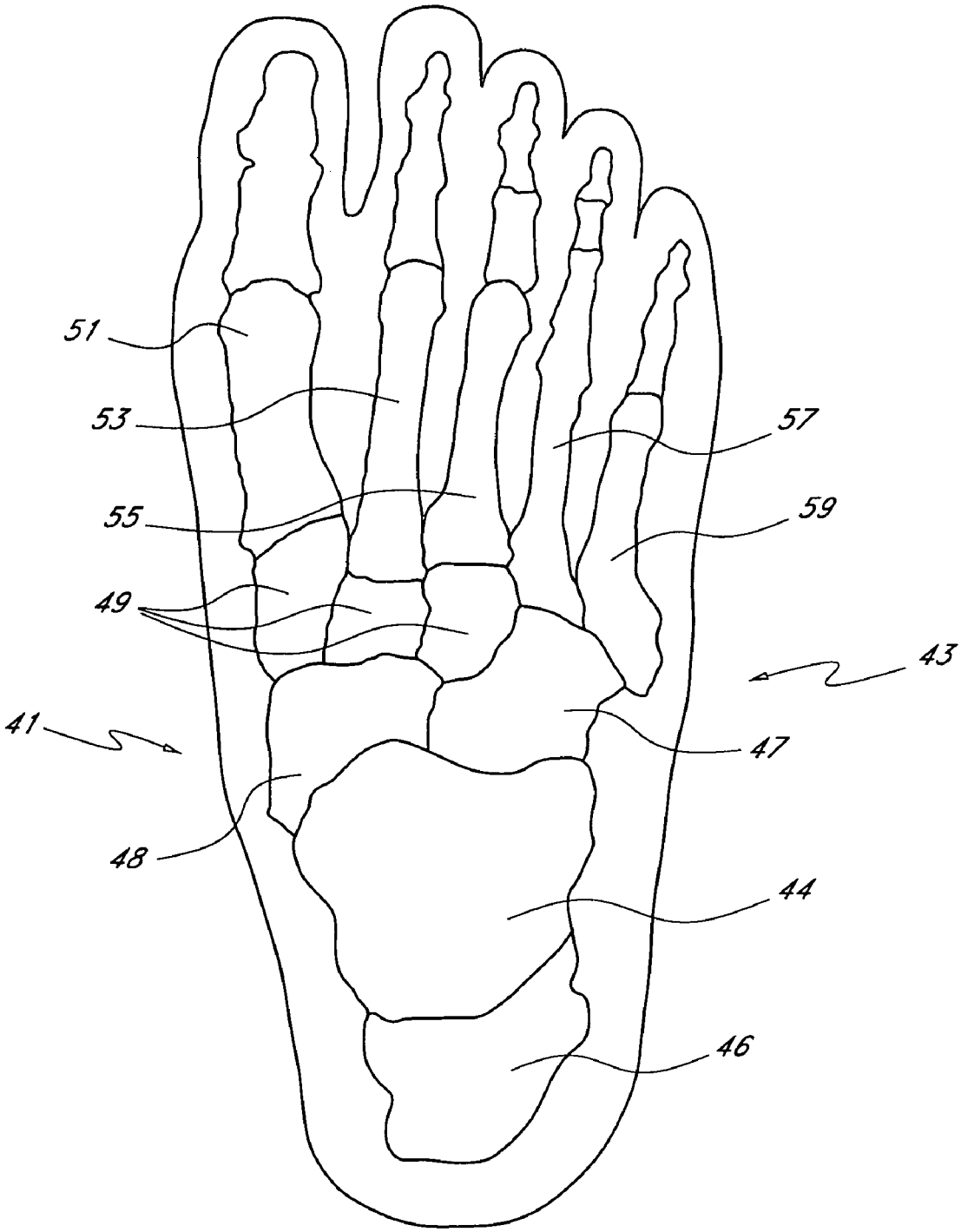
FIG. 3 is a top plan view of the skeletal anatomy of a typical human foot.
Figure 4:
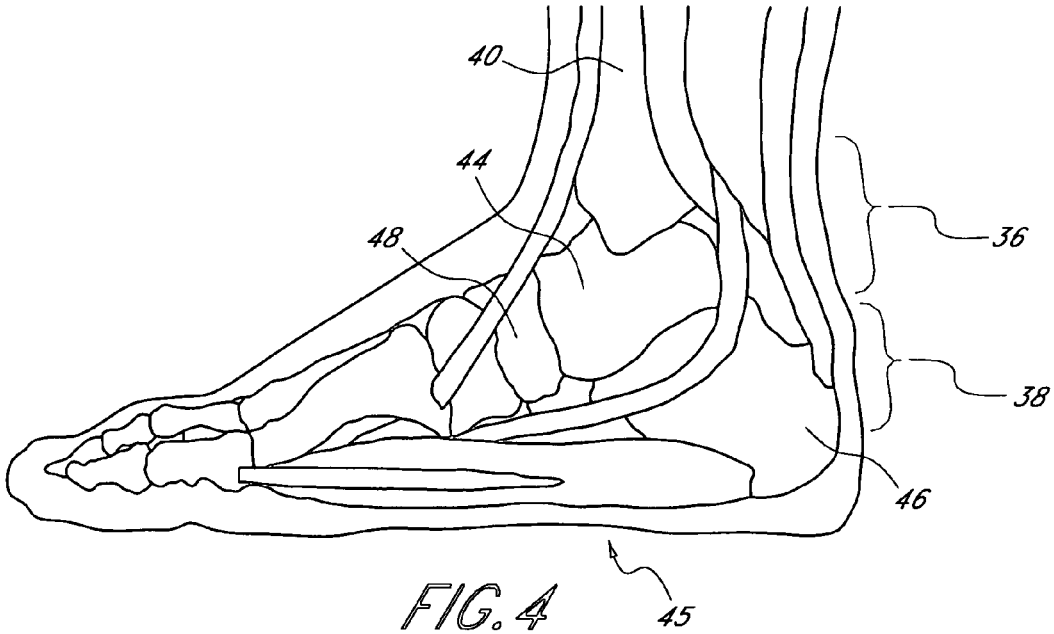
FIG. 4 is a medial elevational view of the anatomy of a typical human foot and ankle.
Figure 5:
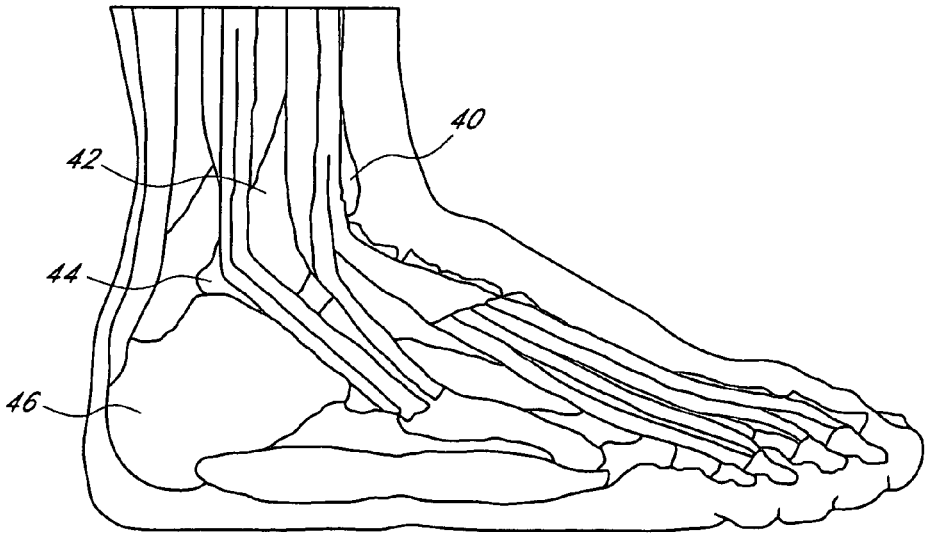
FIG. 5 is a lateral elevational view of the anatomy of a typical human foot and ankle.

Accordingly, FIGS. 3-5 show the anatomical structure of a human foot consisting of 28 bones and having 2 primary joints: the true ankle joint 36 and the subtalar joint 38. The true ankle joint 36 comprises the tibia 40 on the medial portion 41 of the ankle, the fibula 42 on the lateral portion 43 of the ankle, and the talus 44 underneath. The true ankle joint 36 is responsible for down and up foot motion, or plantar flexion and dorsiflexion, respectively. On the medial side 41 of the ankle, a lower portion of the tibia 40 protrudes outwards at a medial malleolus 32 (see FIG. 12). On the lateral side 43 of the ankle, the lower portion of the fibula 42 protrudes outward forming a lateral malleolus 34 (see FIG. 12). These protrusions are commonly referred to as the "ankle bones" and traditionally present an inherently difficult footwear fit problem.

Beneath the true ankle joint is the subtalar joint 38, which consists of the inferior surface of the talus 44 and the superior surface of the calcaneus 46. The subtalar joint 38 provides for side to side motion of the foot, or supination and pronation. A supination movement allows the lateral edge of the foot to bear weight, while a pronation movement shifts the weight to the medial edge of the foot.

The foot has three arches to support the weight borne thereby. The medial longitudinal arch 45 is the highest and most pronounced of the three arches. It is composed of the calcaneus 46, talus 44, navicular 48, cuneiforms 49, and first, second, and third metatarsals 51, 53, 55 respectively. The lateral longitudinal arch (not shown) is lower and flatter than the medial arch and is composed of the calcaneus 46, cuboid 47, and the fourth and fifth metatarsals 57, 59. The transverse arch is composed of the cuneiforms 49, the cuboid 47, and the five metatarsal bases 51, 53, 55, 57, 59. The portion of the instep where the longitudinal arch meets the transverse arch is another key fit area presenting difficult complex contours for footwear to mimic.

A skating motion utilizes a combination of the movements described above. From an initial resting position, a skater flexes an ankle in a pronation direction and leans slightly forward, thereby causing dorsiflexion and angling of the skate to provide resistance such that a stride will propel a skater forward. In many instances, these compound motions are subtle and thus require an efficient transfer of the motion from the skater through the boot. One way to increase the efficiency of the boot is to manufacture the boot to conform closely to the contours of the skater's ankle and foot as provided herein. By contouring the boot to a skater, a minimal amount of padding is required to provide a comfortable fit. By minimizing the padding, the amount of boot slop is reduced, thus providing a more efficient transfer of foot and ankle movements through the boot.

Figure 6:
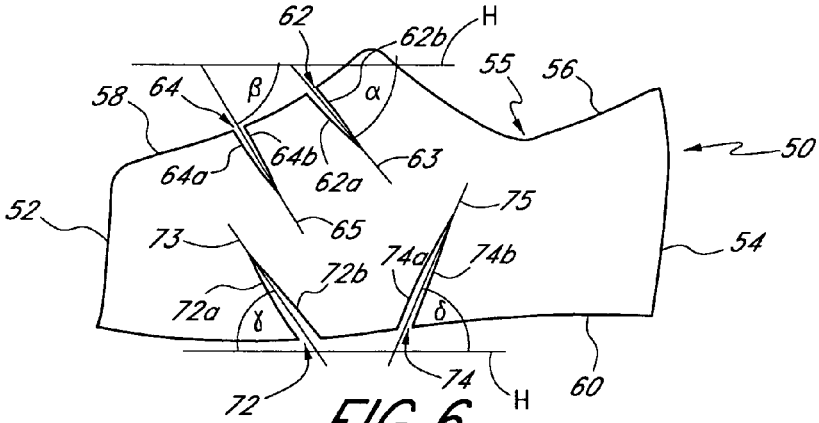
FIG. 6 is an elevational view of a medial quarter panel according to one embodiment of the present contoured skate boot.
Figure 7:
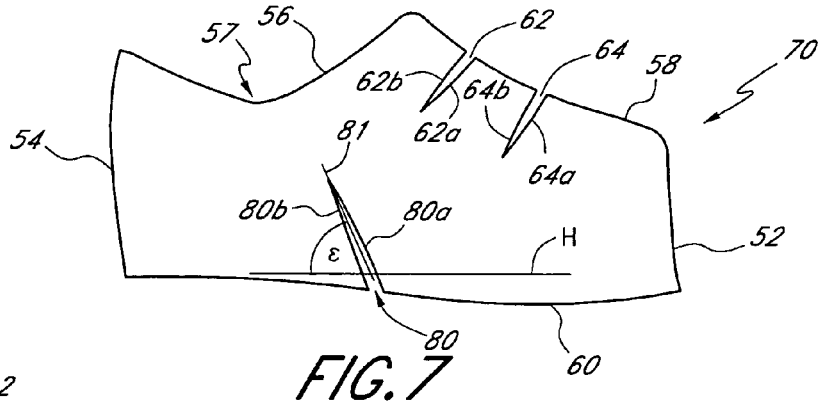
FIG. 7 is an elevational view of a lateral quarter panel according to one embodiment of the present contoured skate boot.
Figure 8:
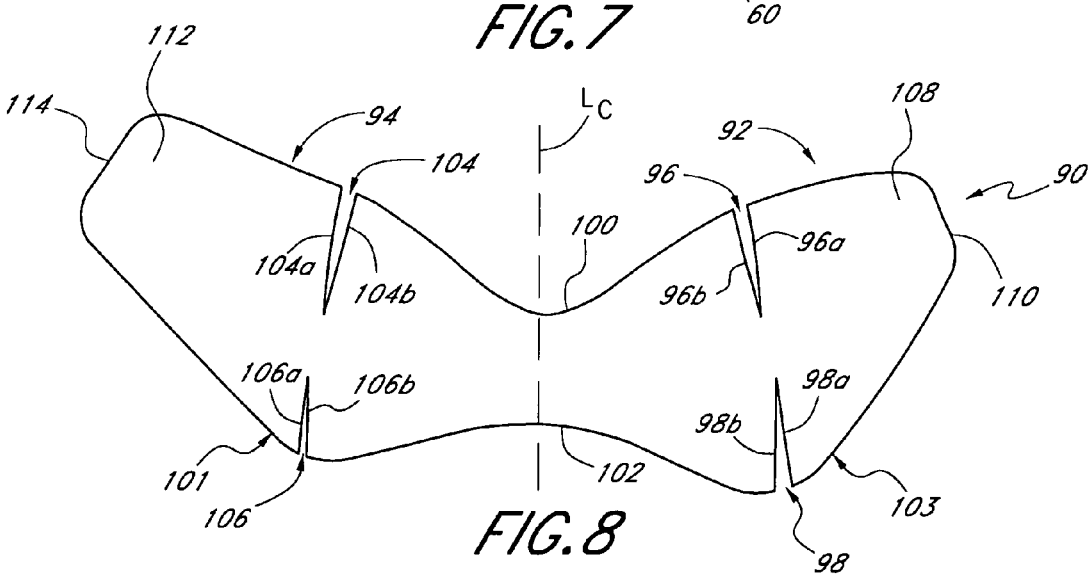
FIG. 8 is a top plan view of an ankle support panel according to one embodiment of the present contoured skate boot.
Figure 9:
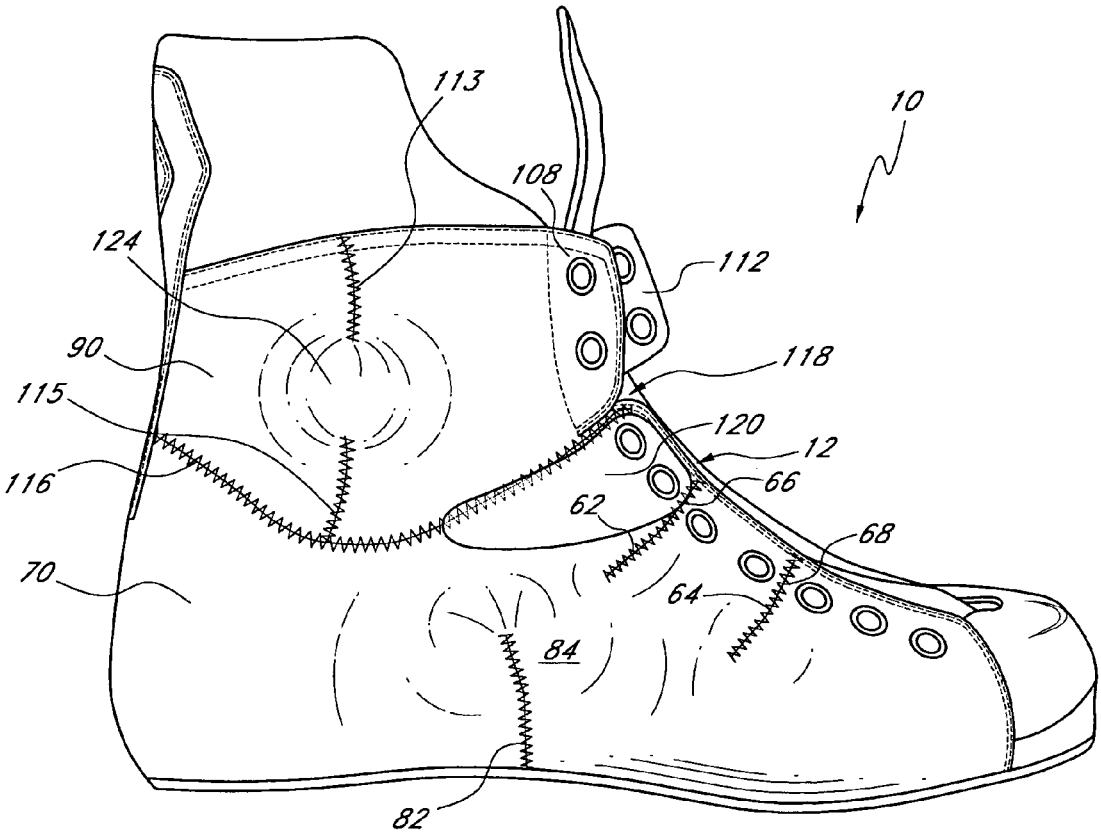
FIG. 9 is a lateral side elevational view of a boot made in accordance with one aspect of the present contoured skate boot.
Figure 10:
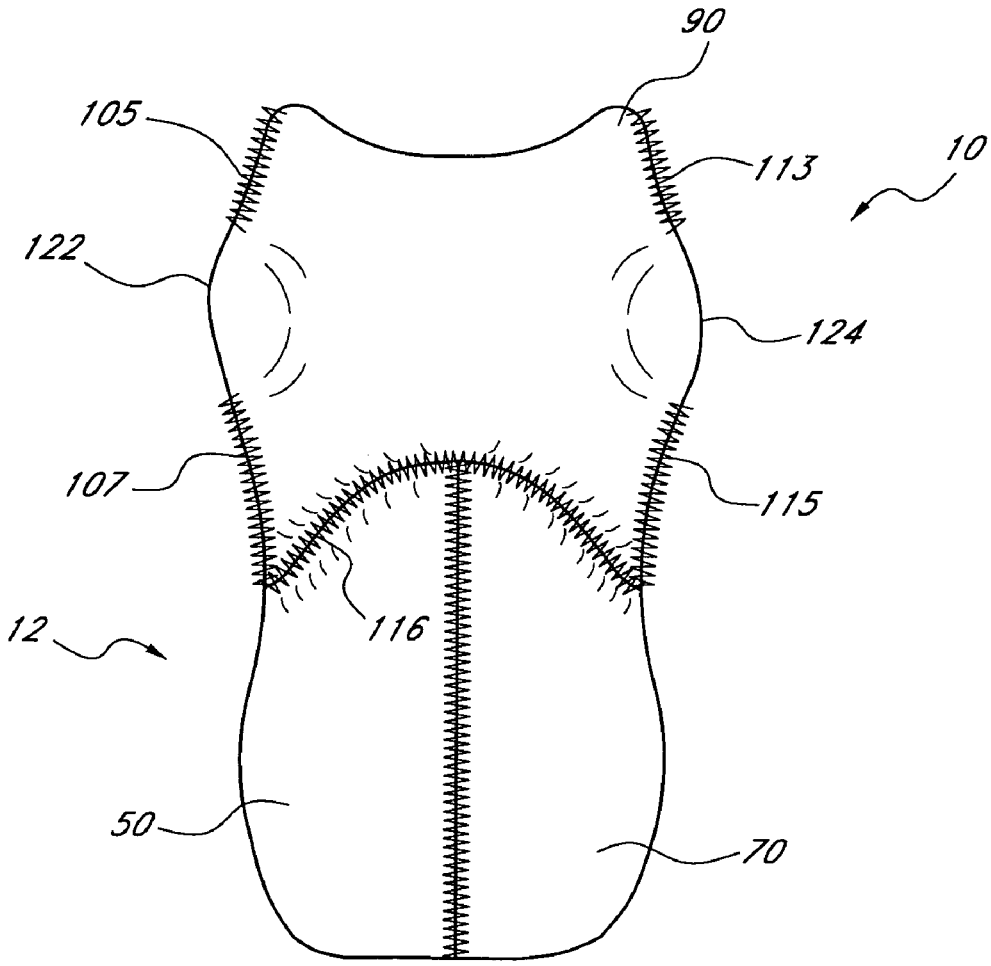
FIG. 10 is a rear view of an assembled boot upper of the boot of FIG. 9.
Figure 11:
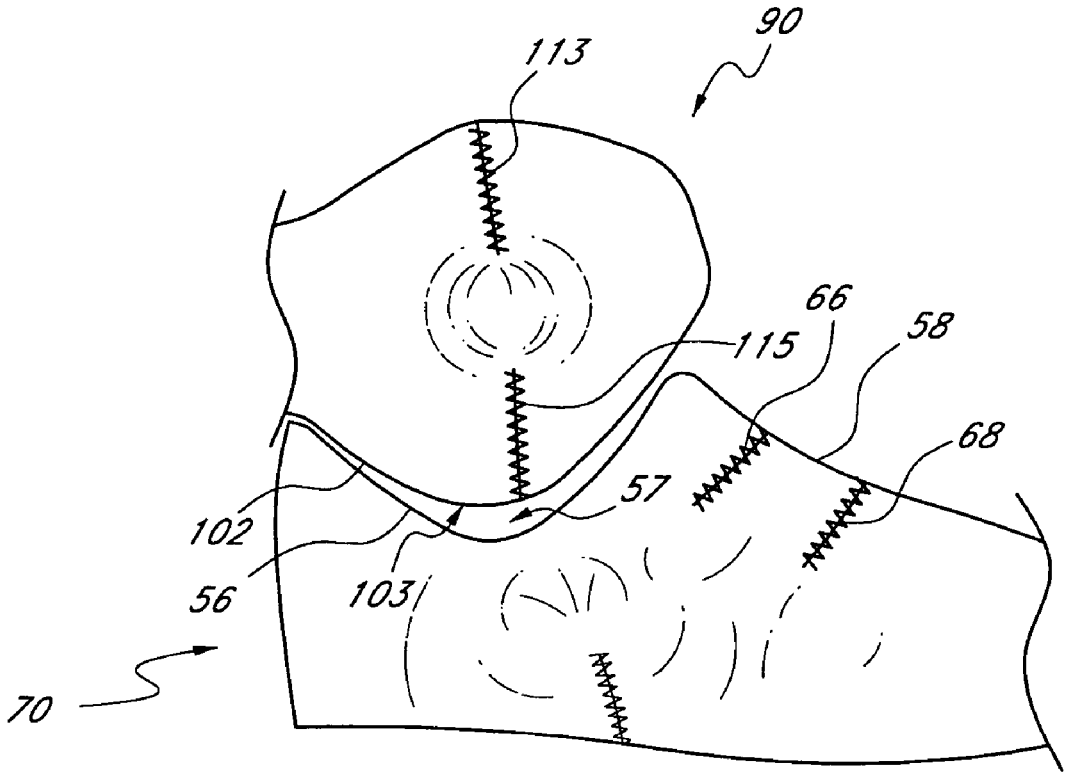
FIG. 11 is a partial view of the fit between the lateral quarter panel and the ankle panel in accordance with one aspect of the present contoured skate boot.

FIGS. 6-11 illustrate flat patterns and construction details of one embodiment of a skate boot 10 constructed in accordance with the present invention. More specifically, FIGS. 6-8 illustrate flat patterns that, when assembled as illustrated in FIGS. 9-11, provide a contoured boot that closely follows the complex shapes of the foot and ankle.

With specific reference to FIGS. 6 and 7, flat patterns are provided for embodiments of a medial quarter panel 50 and a lateral quarter panel 70. FIGS. 6 and 7 show an outer surface of each of the panels 50, 70. Each quarter panel may be cut from a piece of textile material, such as leather, by any known cutting process, such as hand cutting with a scissors or knife, machine cutting, laser cutting, stamping, or any other suitable method of producing the desired shape. Of course, as is generally the case with sewing applications, the individual component pieces of material need not be formed to exacting dimensions as extraneous material can be removed during subsequent assembly steps.

Each of the panels 50, 70 has a front, or toe edge 52, a rear, or heel edge 54, an ankle edge 56, a dorsal edge 58, and a plantar edge 60. The dorsal edges 58 of the medial quarter panel 50 and the lateral quarter panel 70 each preferably have material removed to form one or more contouring notches 62, 64. As illustrated in FIGS. 6 and 7, in each of the medial and lateral quarter panels 50, 70, a first notch 62 and a second notch 64 are spaced apart along the dorsal edge 58 and extend toward the plantar edge 60. Each of the notches 62, 64 are defined by notch edges 62*a, b*, 64*a, b* . . . .

In the illustrated embodiment, the notches 62, 64 are generally V-shaped. However, notches can have other shapes and configurations. Accordingly, it is to be understood throughout this specification that the term "notch" should not be limited to any particular shape, but should be construed broadly to include any location on a pattern or panel from which a portion of the material has been removed, leaving at least two generally opposing edges, which may or may not have similar curvature.

In at least one embodiment, the first notch 62 is between about ½-2 inches long, and more preferably is about one inch long. The first notch preferably is located between about 3-4 inches from the front edge 52 of the respective quarter panel 50, 70, and is more preferably about 3½ inches from the front edge 52. In one embodiment, a line 63 disposed generally centrally within the first notch 62 forms an angle $\alpha$ which is between about 20° and 70° respective to horizontal H when the flat pattern for the quarter panel 50 is held in an orientation generally corresponding to its orientation when formed into a skate boot as shown in FIG. 1. More preferably, the angle $\alpha$ is between about 40° to 65°.

The second notch 64 preferably is located between about 1-3 inches from the front edge 52 of the quarter panel, and more preferably is about 2 inches from the front edge 52. A line 65 disposed generally centrally within the second notch 64 preferably is at an angle $\beta$ that is between about 30° and 80°, and most preferably about 45° and 75°, relative to horizontal H.

With specific reference again to FIG. 6, the medial quarter panel 50 has a pair of cooperating medial arch notches 72, 74 formed from its plantar edge 60 and extending toward the dorsal edge 58. In one embodiment, the first medial arch notch 72 is located about 3-5 inches, and more preferably about four inches, from the front edge 52 of the medial quarter panel 50. The first medial arch notch 72 preferably is between about 1-3 inches long, and most preferably is about two inches long. A center line 73 of the notch 72 has an angle $\gamma$ that is preferably between about 30° and 90° relative to horizontal H. More preferably, the angle $\gamma$ is about 40° to 60°.

The second medial arch notch 74 is located between about 1-2 inches from the first medial arch notch 74 and about 3-6 inches from the front edge 52 of the medial quarter panel 50. More preferably, the second notch 74 is about five inches from the front edge 52. The second notch 74 also preferably is between about 1-3 inches long, and most preferably is about two inches long. An angle $\delta$ between horizontal H and a center line 75 of the notch 74 preferably is between about 30° and 90°, and more preferably is between about 45° to 75°.

With reference next to FIG. 7, the illustrated lateral quarter panel 70 incorporates a lateral plantar notch 80. In the illustrated embodiment, the lateral plantar notch 80 is about 1-3 inches long, and more preferably is about two inches long.

The notch 80 preferably is located about 4-6 inches from the front edge 52 of the lateral quarter panel 70, and more preferably is located about five inches from the front edge 52. An angle $\epsilon$ is defined between horizontal H and a center line 81 of the notch 80. Preferably, the angle $\epsilon$ is about 30° and 90°; more preferably the angle $\epsilon$ is about 45° to 75°.

A flat pattern of an ankle panel 90 is illustrated in FIG. 8. The ankle panel 90 generally comprises a lateral portion 92 and a medial portion 94. The lateral portion 92 has a pair of cooperating notches: an upper lateral malleolar notch 96 that extends downward from an ankle panel upper edge 100, and a lower lateral malleolar notch 98 that extends upward from an ankle panel lower edge 102. Likewise, the ankle panel medial portion 94 has an upper medial malleolar notch 104 and a lower medial malleolar notch 106.

The ankle panel 90 further has a lateral cuff 108 defining a lateral lacing edge 110 and, as shown in FIGS. 1 and 9, is configured with holes and eyelets 20 to accept a lace 22, as is well-known in the art. The opposing medial cuff 112 is similarly configured with a medial lacing edge 114 and is also configured with eyelets to accept a lace.

In at least one embodiment, the ankle panel 90 is not symmetrical about a center line $L_c$ that bifurcates the panel 90. Because an ankle is generally asymmetrical about a vertical plane, the ankle panel is likewise asymmetrical to correspond to the complex contours of the ankle. With specific reference to FIG. 8, the lateral portion 92 is generally vertically lower than the medial portion 94. Additionally, the lateral cuff 108 is shorter than the medial cuff 112 and has a more vertical lateral lacing edge 110 than does the medial lacing edge 114. These variations allow the ankle panel 90 to more appropriately conform to a skater.

Prior to or during assembly of the panels 50, 70, 90 depicted in FIGS. 6-8, the notches 62, 64, 72, 74, 80, 96, 98, 104, 106 are closed by joining opposing notch edges 62*a,b*, 64*a,b*, 72*a,b*, 74*a,b*, 80*a,b*, 96*a,b*, 98*a,b*, 104*a,b*, 106*a,b* together. When the notch edges are joined to one another, residual forces are imparted to the material at or around the notches. These forces bias the flat panel to deform in a predetermined manner. For example, with reference next to FIG. 9, by closing the notches 62, 64, a three dimensional contour is imparted to the initially-flat quarter panel 70.

In the illustrated embodiment, the notches 62, 64 are closed by sewing the notch edges 62*a,b*, 64*a,b* together using a zigzag type seam. Such a sewn-closed notch imparts a contour to its respective panel, and is thus referred to herein as a contour seam 66, 68. Throughout this specification, when opposing edges of one or more panels are joined together in a manner so that the material at or adjacent the joined-together edges is deformed or biased, the joined-together edges are referred to as a "contour seam". The term "contour seam" is intended to be used as a broad term and should not be limited to only edges that are sewn together. Rather, "contour seam" includes edges that have been joined together in any manner, such as by sewing, adhesives, and/or mechanical means such as staples. Further, joining the edges together can include fastening the edges so that the edges engage one another and/or fastening each edge so that the edges, though not necessarily engaged, do not move apart from each other beyond a predetermined distance.

With reference again to FIGS. 6-10, the first notch 62 and second notch 64 of the lateral quarter panel 70 are closed to form contouring seams 66, 68, which introduce a contour into the initially-generally-flat piece of material used for the lateral quarter panel 70. The contouring seams 66, 68 cooperate to introduce a contour that can either be convex or concave when viewed from the outer surface. In the embodiment illustrated in FIG. 9, the contour seams 66, 68 of the lateral quarter panel 70 create a concave contour along the dorsal edge 58, but create a generally convex contour in the lateral quarter panel 70 adjacent an end of the contour seams 66, 68 opposite the dorsal edge 58. Likewise, the first notch 62 and second notch 64 of the medial quarter panel 50 preferably are closed to form corresponding contouring seams on the lateral side of the boot.

The lateral plantar notch 80 is preferably used to form a lateral contouring seam 82 which, in the embodiment illustrated in FIG. 9, creates a generally concave contour adjacent the plantar edge, but creates a generally convex contour in the panel 70 adjacent an end of the contour seam 82 opposite the plantar edge 60. As best shown in FIG. 9, the contour seams 66, 68, 82 in the lateral quarter panel 70 cooperate to bias the panel to a generally concave contour along a portion of the dorsal and plantar edges, but also to create a generally convex contoured bulge 84 in the panel. The convex lateral bulge 84 accommodates the foot contour created along a skater's outstep by the proximal end of the fifth metatarsal bone 59 and the accompanying ligaments and tendons, while the concavity along the edges 58, 60 helps the panel 70 partially wrap around a wearer's foot.

When the respective notch edges 72*a,b*, 74*a,b* of the medial arch notches 72, 74 are joined, medial arch contouring seams (not shown) are created which impart residual force into the medial panel 50. In one embodiment these forces bias the medial quarter panel 50 to create a concave contour conforming to a skater's medial longitudinal arch 45.

With specific reference to FIGS. 8-11, the upper and lower lateral malleolar notches 96, 98 of the ankle panel 90 are used to form malleolar contour seams 113, 115 which cooperate to form a substantially convex bulge 124 in the ankle panel lateral portion 92 at a location generally between the cooperating notches 96, 98. Likewise, the upper and lower medial malleolar notches 104, 106 cooperate to form contour seams 105, 107 that define a convex bulge 122 in the medial portion 94 of the ankle panel 90, as will be described below in further detail.

It should be understood that additional embodiments can include other notch configurations and placement. More specifically, additional embodiments can include notches of different dimensions, configurations, angles, and locations that will result in differing contouring characteristics of the finished boot. Additionally, at least the dimensions and locations of the notches may be directly related to the size of the finished boot. Additionally, the size, shape and curvature of the notches and notch edges determines the resulting contour of the notched panel. As such, various contour characteristics can be achieved by varying the notch configuration. Accordingly, the illustrated preferred embodiment does not limit, but merely describes, one embodiment encompassed by the scope of the pending claims.

In accordance with one embodiment, a notch is closed by stretching the flat pattern in order to join the notch edges together, and then releasing the flat pattern so that the residual forces in the material deform the panel. In accordance with another embodiment, a notch is closed by first deforming the panel material into a three dimensional shape in order to align the notch edges and then joining the notch edges so that the panel retains the deformed three dimensional shape. It is to be understood that any suitable method can be used to close the notches so that the respective panel is biased along a desired contour.

In one preferred embodiment, contouring seams are first formed in the respective panels 50, 70, 90, and the panels are then sewn together to form a boot upper 12. While the sequence is generally not important, the medial quarter panel 50 and lateral quarter panel 70 are typically joined first along their respective heel edges 54, 52 to form a heel counter. The contour of the heel edges 54, 52 provides an interior heel shape that will naturally conform to the shape of the last. The ankle edges 56 of the quarter panels are generally continuous once the medial quarter panel 50 is joined to the lateral quarter panel 70. This provides a continuous edge for attachment to the ankle panel 90 lower edge 102.

With specific reference to FIG. 11, it should be noted that, in at least some embodiments, the continuous ankle edge 56 of the combined quarter panels 50, 70 does not track the identical curvature of the ankle panel lower edge 102. More specifically, malleolar portions 55, 57 of the ankle edge 56 generally follow a first radius of curvature, while corresponding portions 101, 103 of the ankle panel lower edge 102 generally follows a second radius of curvature that is different than the first radius of curvature. In the illustrated embodiment, the second radius of curvature is greater than the first. In an additional embodiment, the radius of curvature of the portions 55, 57, 101, 103 each are different from one another.

In the illustrated embodiment, the ankle edge 56 and ankle panel lower edge 102 are joined together along a main seam 116. As the ankle edge 56 and ankle panel lower edge 102 are joined together, biases are introduced into the panels. It can be seen in FIGS. 9-10 that one of these described biases results in a contour along the back of the skate boot 10, thus providing a contoured fit to the Achilles area (131 of FIG. 13) and lower portion of the ankle. Another desirable result is that portions of the quarter panels 50, 70 and ankle panel 90 deform inwardly along the main seam 116. This improves the fit of the boot about the skater's foot below the ankle, which is an area of particular importance in fitting the skate boots, and which area typically is difficult to fit.

With continued reference to FIGS. 9-10, in addition to providing a contour to the boot, the main seam 116 may additionally provide a hinge, or fold line, for flexure of the finished boot 10. Thus, the main seam increases the flexibility of the boot to better allow for plantar flexion and dorsiflexion motions as well as pronation and supination motions than if the ankle and quarter panels were formed integrally.

While the description herein is written in terms of seams created by sewing, other forms of mechanical or chemical assembly and bonding are contemplated herein. Moreover, contour seam locations other than those described herein can be used.

It is to be understood that, while the use of individual components to form the ankle panel 90, medial quarter panel 50, and lateral quarter panel 70 is described in the illustrated embodiments, the individual panels may be formed integrally in other embodiments. Alternatively, the medial quarter panel 50 and the lateral quarter panel 70 may be formed integrally and, for example, may be interconnected along their respective heel edges 54, 52 or may be connected by an elongate portion of their respective plantar edges 60, without departing from the advantages described herein.

Not only do the contouring seams provide for a better finished fit, they also increase the efficiency of the lasting process, as compared to typical hand-crafted boots. As discussed above, hand-crafted boots typically are formed by stretching the boot upper panels to conform to the contours of a last. The lasting process is a labor intensive process requiring great skill and patience to pull, stretch, and force the unwilling material into a specific three-dimensional shape corresponding to the last. In contrast, an embodiment of a boot upper having contouring seams, the upper 12 is pre-biased into a contoured shape. Therefore, the contouring seams cause the boot upper 12 to more naturally follow the contours of the last, and hence, speed up the manufacturing process.

FIG. 9 illustrates further advantages of the contoured skate boot 10 including the asymmetry between the lateral cuff 108 and medial cuff 112. The medial cuff 112 extends forwardly further than the lateral cuff 108. This asymmetrical configuration allows the medial cuff 112 to better conform to the true contours of the foot as it wraps around the ankle during lacing and tying. The improved cuff fit is further enhanced by a throat 118 disposed between the ankle panel 90 and the lateral quarter panel 70. The throat 118 facilitates limited relative movement between these panels, allowing the panels to better conform to the foot and ankle contours of a skater and thereby creating a better fit than if the panels were more closely constrained together.

With continued reference to the embodiment illustrated in FIG. 9, a force direction member 120 is disposed adjacent and below the throat 118 on the lateral quarter panel 70. The force direction member 120 distributes the lacing force to an area of the ankle just below the lateral malleolus 34. As discussed above, this is typically a problem fit area for footwear. By distributing lacing forces as discussed, the force direction member 120 provides increased support for the subtalar joint. Additionally, the force direction member 120 preferentially directs flexing of the boot in plantar flexion and dorsiflexion to the throat 118 and along the main seam 116. This not only helps maintain improved and repeatable response of the boot to foot movements, but also desirably reduces breakdown of the boot by directing boot flexure to a specified location that can be designed to accommodate such stresses. By directing the boot flexure along the main seam in the illustrated embodiment, the force direction member facilitates flexibility at this location and also avoids excessive damage to the panels that would result from repeated flexure of the panel material.

The force direction member 120 can be made of any suitable material that provides an increase in resistance to bending such as leather, other textiles, plastics, resins, and the like. In the illustrated embodiment, the force direction member 120 is constructed of molded plastic. While a force direction member 120 is typically placed on the lateral side of the boot separating the lateral cuff 108 from the lateral quarter panel 70, one or more may additionally be placed on the medial side of the boot.

The positioning of the force direction member 120 can be selected depending on the desired bending characteristics of the finished boot. For example, in the illustrated embodiment, the force direction member 120 follows the line of the main seam 116. In other embodiments, the force direction member 120 overlaps the main seam 116. Additional force directing members may be placed at other desired locations on the exterior of the boot. For example, a force directing member may be placed just below the medial malleolus 32 and/or lateral malleolus 34. Additional force directing members may be located to conform the boot to the concavity created by the medial longitudinal arch and transverse arch, along the Achilles tendon region (131 of FIG. 13) at the back of the ankle, or along the dorsal surface of the foot.

Figure 12:
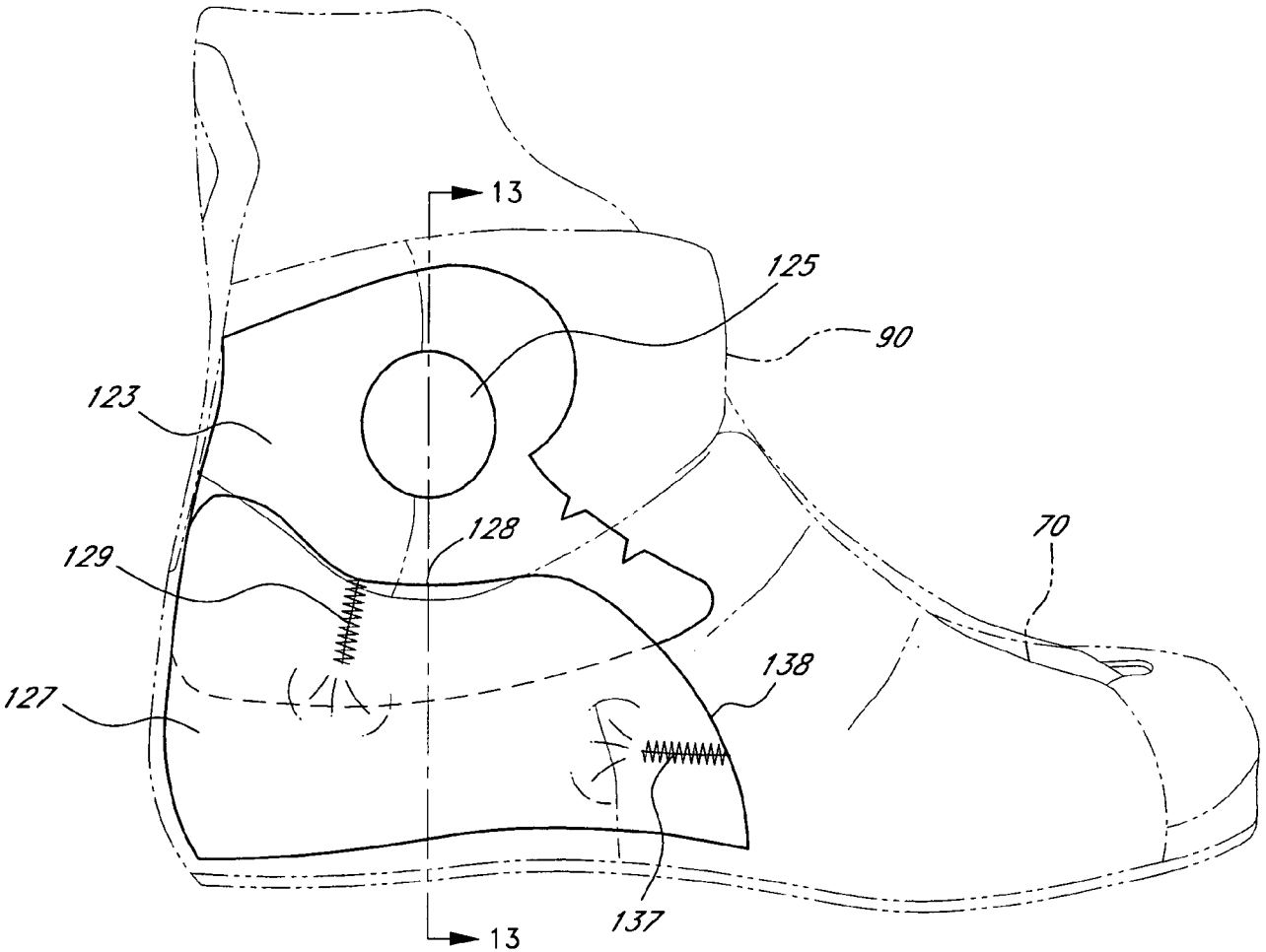
FIG. 12 is a lateral side elevational view showing the internal stiffeners arranged inside the later quarter panel and ankle panel, which are shown in phantom.
Figure 13:
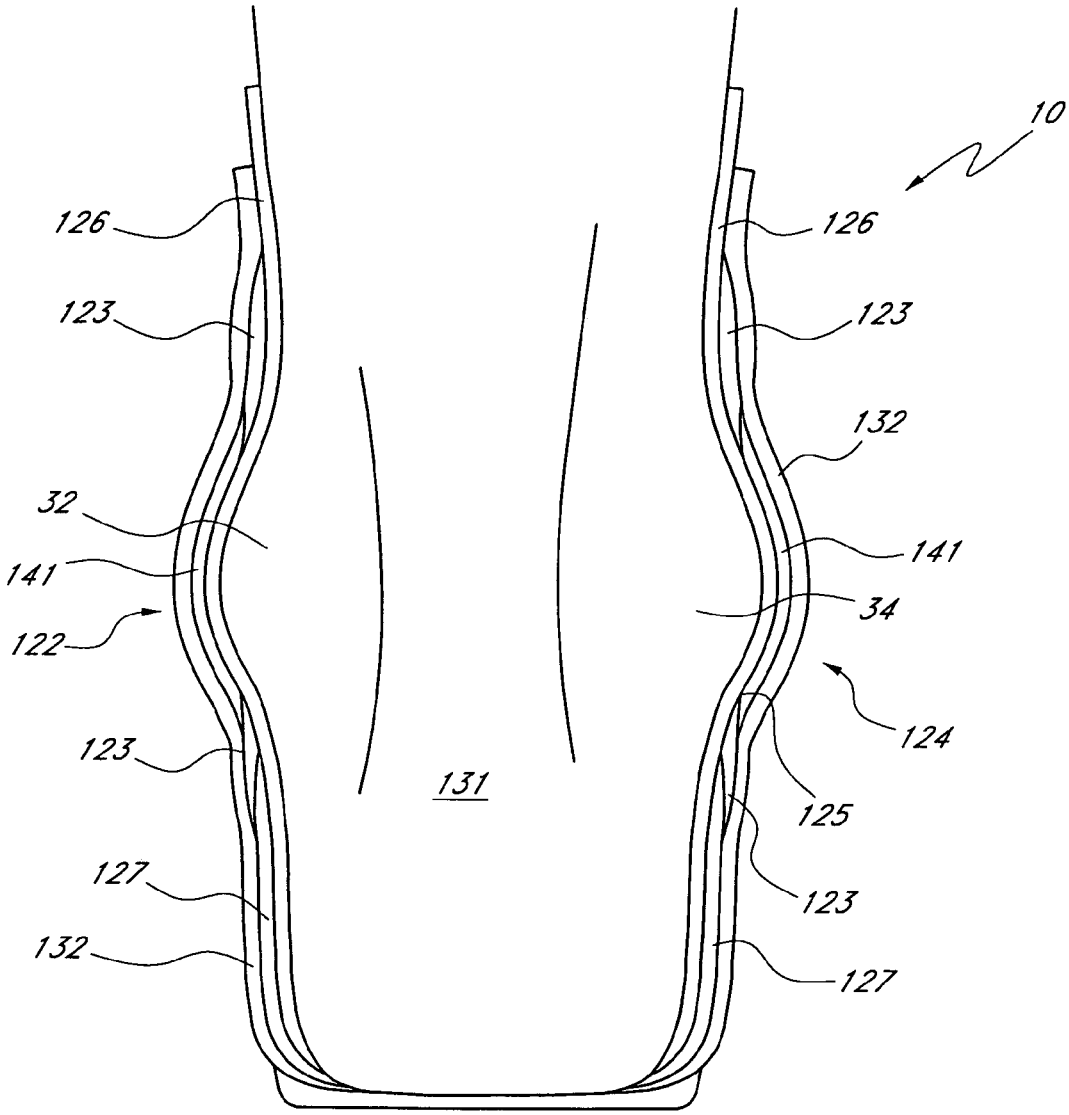
FIG. 13 is a cross-sectional view of the skate boot of FIG. 12 taken along line 13-13, and showing a wearer's foot disposed in the boot.

In order to provide appropriate boot stiffness and support, the boot preferably comprises a plurality of stiffeners, which may be internal and/or external. With reference next to FIGS. 12 and 13, another embodiment is illustrated incorporating interior stiffeners 123, 127 which may be attached to the boot upper by adhesives and/or sewing. The interior stiffeners function to add increased support to the wearer and longevity to the boot, and can also protect the wearer from injury due to impacts by a hockey puck, stick or the like. The internal stiffeners may be formed of any suitable material. In a preferred embodiment, the internal stiffeners each comprise a chemical sheet or fiber sheet which, in some embodiments, is saturated or coated with a resin and/or other hardening agent.

In the embodiment illustrated in FIG. 12, a lateral quarter panel 70 and ankle panel 90 are shown in phantom, and an ankle stiffener 123 and a heel counter stiffener 127 are secured to the inside surface of the lateral quarter panel 70 and ankle panel 90. In the illustrated embodiment, the stiffeners 123, 127 are separately-formed and partially overlap one another. The internal stiffeners preferably are shaped, such as by beveling their edges, to enhance the interior fit of the boot. Further, the stiffener material thickness can be varied to provide clearance for the contours of the foot and ankle.

The heel counter stiffener 127 increases the stiffness and shape of the heel counter region of the boot. In the illustrated embodiment, the heel counter stiffener 127 comprises an upper edge 128 that generally follows the curve of the main seam 116, at which the lateral quarter panel 70 and ankle panel 90 are joined. As shown, a contouring seam 129 extends from the upper edge of the heel counter stiffener 127. The contour seam 129 creates a convex contour which accommodates the lower portion of the wearer's foot and ankle, but also creates a contour that biases the boot inwardly toward the upper edge 128. As such, the heel counter stiffener 127 works in concert with the main seam 116 and ankle panel contour seams 113, 115 to bias the boot upper inwardly below the malleolus. This helps to improve the fit of the boot in this important area of the ankle. Preferably, a similar contouring seam is provided on the medial side of the heel counter stiffener so as to provide a similar fit effect on the medial side.

With continued reference to FIG. 12, a forward heel counter contour seam 137 extends from a forward edge 138 of the heel counter stiffener 127. In the illustrated embodiment, the forward heel counter contour seam 137 creates a contour that complements the contour 84 (see FIG. 9) created by the contour seams 66, 68, 82 of the lateral quarter panel 70 in order to bias the boot upper into a shape that resembles the curves of a foot placed therewithin. Preferably, a forward heel counter contour seam is also provided on the medial side of the boot, and complements the contour seams of the medial quarter panel 50.

In the illustrated embodiment, the contour seams 129, 137 of the heel counter stiffener 127 are not aligned with the contour seams 66, 68, 82 of the associated quarter panels. However, the stiffener and quarter panel contour seams cooperate with one another to even more effectively bias the boot upper as desired. It is to be understood that, in additional embodiments, contour seams in the stiffeners can roughly correspond to the positions of contour seams in the quarter panels.

With continued reference to FIG. 12, the illustrated ankle stiffener 123 comprises an aperture 125 formed therethrough to provide clearance for the lateral malleolus 34. Preferably, the ankle stiffener extends around the back of the boot and also fits about the medial side of the ankle. Further, the ankle stiffener 123 preferably comprises a second aperture (see FIG. 13) configured to provide clearance for the medial malleolus 32. In this manner, the ankle stiffener 123 supports the boot upper to fit closely against the foot in the areas adjacent the lateral and medial malleolus, and the ankle stiffener 123 does not have to bend substantially to accommodate the malleolus. It is to be understood, however, that in additional embodiments the ankle stiffener can include contour seams to create a malleolar bulge in a manner similar to the contour seams of the quarter panels.

It is to be understood that other contouring seams may be applied along other directions, dimensions, configurations, and within other internal stiffeners. Additionally, various numbers, types, configurations, shapes, and locations of internal stiffeners can be employed. For example, in still further embodiments, a general stiffener extends generally concomitant with the quarter panels. Further, stiffeners of various materials can be used without departing from the scope hereof.

In further embodiments, relatively rigid stiffeners can be employed in certain areas of the boot. For example, in one embodiment, a rigid polymer ankle cap is disposed over each of the lateral and medial malleolus. The ankle cap is configured to protect the ankle from injury due to impacts with a hockey puck, stick or the like.

With specific reference to FIG. 13, a cross-sectional view is provided of the embodiment of FIG. 12 taken along line 13-13. A wearer's foot is also shown disposed in the boot. As shown, the medial and lateral quarter panels 50, 70, along with the ankle panel 90 comprise a textile layer 132. The textile layer 132 is made of any appropriate material such as, for example, leather, fabric, pliable polymer sheets, or other material suitable for the outer layer of a skate boot. Preferably, the textile layer 132 is initially assembled as a boot upper biased by contour seams into a contoured shape conforming to a skater's foot and ankle.

Internal stiffeners such as the ankle stiffener 123 and heel counter stiffener 127 add rigidity, longevity, and protection to the wearer, and further enhance the contoured shape as previously discussed. In the illustrated embodiment, a rigid ankle cap 141 provides additional impact protection to the lateral malleolus 34 and the medial malleolus 32.

Finally, a padding layer 126 is disposed within the interior of the boot to provide comfort. Contrary to traditional skate boots, which require a relatively thick layer of padding to fill the space created between the boot and the skater's foot, the padding layer 126 is relatively thin, which results in a lighter boot. Additionally, the thin padding layer is less likely to develop a memory from repeated deformation, thus reducing boot slop when compared with traditional skate boots. The padding layer typically has a thickness within the range of from about 2 mm to 4 mm, as opposed to traditional skate boot padding which may be up to about 15 mm thick. Therefore, by minimizing the padding, boot control and response are both increased while the overall weight is decreased. It should be understood that additional padding may be added at strategic locations, such as in the proximity of the medial malleolus and the lateral malleolus, to provide increased comfort and protection.

The padding layer 126 may be formed of a single layer of material, such as, for example, open cell foam, closed cell foam, sponge foam, ethylene vinyl acetate (EVA), neoprene, and any other suitable materials. Additionally, the padding layer 126 may be formed of a combination of various types of materials and in varying thicknesses. The padding layer may additionally or alternatively include a plurality of padding components that overlap, abut, and cooperate to provide the required comfort demanded by skaters.

It can be seen that the illustrated contoured skate boot 10 closely conforms to the contours of a typical foot and ankle, and more specifically, each layer of the contoured skate boot 10 is manufactured to conform to the complexities of a skater's foot and ankle. Of course, it is also to be understood that further layers of internal and external stiffeners and the like can acceptably be used.

With reference again to FIGS. 1 and 2, external stiffeners 130 may be added to the boot to increase stiffness, enhance aesthetics, and protect both a skater and a boot from impact-type injuries such as those caused by pucks, sticks, and other skates. The external stiffeners 130 may be formed of a chemical sheet coated with a thermoplastic resin, such as, for example, SURLYN™, manufactured and sold by DuPont. SURLYN™ is preferred in many embodiments for its high impact strength, its natural transparency coupled with its ability to take on colored dyes, and its low softening point that allows it to be effective during a heat fitting process. Of course, other types of materials are available that can be used as external stiffeners 130, including composite materials such as carbon fiber or fiberglass fiber combined with cured or noncured resins.

In at least one embodiment, it is preferable to heat fit the boot to a particular skater. Heat fitting is a process in which a boot is heated, such as in an oven, to a specified temperature, such as from about 80° Fahrenheit to about 200° Fahrenheit. The heat causes the boot materials to expand and the adhesives to relax, thereby increasing the pliability and deformability of the boot. Thus, when the heated boot is laced and tightened around a user's foot and ankle, the boot materials, including the internal stiffeners, adjust to better fit the wearer's foot. In the embodiments discussed above, since portions of the boot are biased by contour seams further these biased portions conform more easily to the corresponding portions of the wearer's foot than would a naturally flat material. As the boot cools while being worn, the adhesives harden and the materials assume the adjusted shape. It is to be understood that the contouring seams allow the heat fit process to be accomplished faster and at lower temperatures than prior art boots because the initial boot shape more closely approximates the desired final, custom-fit, shape.

The heat fit process can be problematic for boots constructed according to more traditional methods. As described above, during the lasting process, materials are stretched and forced to conform to the last. Thus, the materials are biased away from a foot-like shape. As such, during the heat fitting process, when the adhesives relax in response to the increased temperature, the material tends to return to its original, non-conforming shape. In contrast, in a boot having contour seams, relaxing the adhesives allows the biased portions of the boot to even better conform themselves to the contours of the wearer's foot.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A skate, comprising:

(a) a skate boot for receiving a human foot, the skate boot comprising (i) a heel counter for facing the heel of the foot; (ii) an ankle panel for facing the ankle; (iii) medial and lateral quarter panels for facing the medial and lateral sides of the foot respectively, the medial and lateral quarter panels having medial and lateral front edges; and (iv) a toe cap for covering the toes of the foot, the toe cap being affixed to the medial and lateral front edges of the medial and lateral quarter panels; wherein each of the medial and lateral quarter panels has a lace edge, a sole edge, and a central portion between the lace and sole edges, the lace edge being adapted to support a skate closure system; and wherein the lace edge comprises at least one V-shaped notch along the lace edge, the at least one V-shaped notch having opposite edges being joined to one another to form a lace edge contour seam adapted to impart a bias to the central portion of the quarter panel, the bias being generally transverse to the panel;

(b) a rigid outsole fixed to a bottom of the skate boot; and (c) an ice blade holder mounted to a bottom of the rigid outsole.

2. The skate of claim 1, wherein the skate closure system comprises laces.

3. The skate of claim 1, wherein the V-shaped notch is closed with a sewing stitch to form the contour seam.

4. The skate of claim 1, wherein the sole edge comprises at least one notch along the sole edge and being closed to form a first sole edge contour seam adapted to impart a bias to the central portion of the quarter panel, the bias being generally transverse to the panel in generally the same direction as the bias imparted by lace edge contour seam.

5. The skate of claim 4, wherein the sole edge comprises a second contour seam adapted to impart a bias to the central portion of the quarter panel, and the first and second sole edge contour seams are elongate and generally lie on lines that are generally skew relative to one another.

6. The skate of claim 1 additionally comprising a stiffener member adhered to an inside surface of the quarter panel, wherein the stiffener member has a top edge, a generally opposed bottom edge, and a central portion between the top and bottom edges, and a notch along one of the stiffener edges being closed to form a stiffener contour seam adapted to impart a bias to the stiffener central portion, the bias being generally transverse to the stiffener member.

7. The skate of claim 6, wherein the stiffener contour seam does not align with any contour seam of the quarter panel.

8. The skate of claim 6, wherein the stiffener contour seam and quarter panel contour seam collectively create a generally convex bias in the quarter panel central portion.

9. The skate of claim 6 additionally comprising an ankle cuff having a lower edge, wherein the quarter panel has an upper edge joined with the ankle cuff lower edge to form an ankle seam, and wherein an upper edge of the stiffener is generally aligned with the quarter panel upper edge.

10. The skate of claim 9, wherein the ankle cuff lower edge has a first curvature when the ankle panel is laid out substantially flat and the quarter panel upper edge has a second curvature when the quarter panel is laid out substantially flat, the first and second curvatures not being complementary to one another, and wherein at least one of the ankle and quarter panels is deformed so as to align and join the lower and upper edges to one another so that the ankle seam is biased generally inwardly.

11. The skate of claim 9 additionally comprising a force direction member extending generally along the ankle seam and wherein the closure system is adapted to engage and apply force to the lace edge of the quarter panel and a portion of the force direction member.

12. The skate of claim 11, wherein the force direction member is made of plastic.

* * * * *